US005517766A

United States Patent [19]

Wulz et al.

[11] Patent Number: 5,517,766

[45] Date of Patent: May 21, 1996

[54] PAPER MACHINE DRYING SECTION

[75] Inventors: Hans-Jürgen Wulz; Bernd Fremdt, both of Heidenheim, Germany

[73] Assignee: Voith Sulzer Papiermaschinen GmbH, Heidenheim, Germany

[21] Appl. No.: 372,009

[22] Filed: Jan. 12, 1995

[30] Foreign Application Priority Data

Jan. 15, 1994 [DE] Germany ..... 44 01 028.1

[51] Int. Cl.[6] ..... F26B 11/02

[52] U.S. Cl. ..... 34/117; 34/116

[58] Field of Search ..... 34/114, 116, 117

[56] References Cited

U.S. PATENT DOCUMENTS

| | | | |
|---|---|---|---|
| 4,854,053 | 8/1989 | Skaugen | 34/117 |
| 5,050,317 | 9/1991 | Kade et al. | 34/117 |
| 5,177,880 | 1/1993 | Preisetanz et al. | 34/117 |

*Primary Examiner*—Henry A. Bennett
*Assistant Examiner*—Dinnatia Doster
*Attorney, Agent, or Firm*—Marshall, O'Toole, Gerstein, Murray & Borun

[57] ABSTRACT

A paper machine dryer group has a plurality of rolls, including a guide roll and a tension roll, and a carrier belt traveling over the rolls and forming a continuous loop. The guide roll can be displaced to a location parallel to its axis as well as at an angle to the direction of movement of the carrier belt. The guide roll and the tension roll are coupled to each other in such a way that, when the guide roll is displaced, the tension roll is simultaneously displaced in such a direction and to such an extent that the carrier belt tension remains at least approximately constant.

6 Claims, 2 Drawing Sheets

PAPER MACHINE DRYING SECTION

BACKGROUND OF THE INVENTION

1. Field of the Invention

The invention relates to paper machine components and in particular to paper machine dry sections having a plurality of drying cylinders and guide rolls looped about by an endless carrier belt.

2. Description of Related Technology

Dryer sections of paper machines are disclosed, for example, in Kade et al., U.S. Pat. No. 5,050,317 and Preisetanz et al., U.S. Pat. No. 5,177,880. These patents disclose dryer sections with single-row dryer groups in which a plurality of dryer cylinders are disposed in a row and a suction-deflection roll is provided between two neighboring dryer cylinders. An endless carrier or support belt, also known as a dryer wire, loops in alternating fashion around the suction-deflection rolls and the dryer cylinders. During operation, a paper web to be dried is guided by the carrier belt as the paper and the belt travel about a dryer cylinder. The paper web is sandwiched between the surface of the dryer cylinder and the carrier belt.

Normally, a dryer section contains several dryer groups so that a paper web is transferred from one dryer group to the next during its passage through the paper machine.

At an initial region of the dryer section, the paper web has a relatively high water content and thus a relatively low strength. Therefore, the paper web is always supported by the carrier belt of a particular dryer group. The dryer groups are arranged such that the paper web is fully supported at transfer regions between the dryer groups. In such a transfer region, the web comes into contact with a carrier belt of a next dryer group positioned directly downstream with respect to a direction of travel of a paper web through the paper machine, but at the same time remains in contact for a small distance with the carrier belt of the previous (i.e., upstream) dryer group. Thus, the paper web is sandwiched between the two carrier belts for a short time.

However, due to the paper web low strength mentioned above, tearing of the paper web often occurs. Also, large amounts of waste may be produced within a short time due to the high velocity of travel of the paper web through the paper machine. The waste must be removed as fast as possible so that it does not cause damage to the guide rolls, dryer cylinders or dryer screens.

In order to be able to remove paper jam as fast as possible, the transfer region between dryer groups is preferably designed so that it can be "opened" rapidly. This is achieved, for example, by moving a dryer wire of a first dryer group away from a guide roll of a neighboring dryer group via corresponding displacement of a guide roll in the transfer region, so that the waste can fall into a machine cellar. The guide roll can be a suction roll which is located during normal operation within the wire loop of the neighboring dryer group and which is disposed near a last dryer cylinder of the previous (i.e., upstream) dryer group. See, for example, FIG. 1 of U.S. Pat. No. 5,177,880 which shows a suction guide roll near a dryer cylinder 13. FIG. 2 of U.S. Pat. No. 5,050,317 shows a dryer section arrangement in which a guide roll 194 can be displaced so that a dryer wire 174 of a dryer group can be moved away from a dryer wire 175 of the next (i.e. downstream with respect to a direction of travel of a web through the dryer groups) dryer group.

Displacement of guide rolls generally results in a change of the tension of a cooperating dryer wire. To keep the tension constant, tension rolls may be provided within each dryer wire loop. The tension rolls receive signals from tension sensors which first record a change in wire tension and then give an appropriate command to the tension roll. However, as described above, a dryer wire becomes displaced during an "opening" process of a transfer region between dryer groups, as well as during a corresponding closing process of the region, which can lead to significant interruption of the operation of the dryer section and also to continual tearing of the paper web.

In dryer sections known in the art described herein, application of tension to a dryer wire, after it becomes slack, does not take place fast enough. This is due to a certain inertia of the tension roll sensor system and of the tension roll control system.

SUMMARY OF THE INVENTION

It is an object of the invention to overcome one or more of the problems described above. It is also an object of the invention to provide a component of a paper machine, especially a dryer group of a dryer section of a paper machine wherein the tension of an endless belt that loops about the dryer group always remains the same, even during the opening and closing processes of a transfer region between dryer groups, and does not change even for short time periods.

According to the invention, a paper machine dryer group has a plurality of rolls, including a guide roll and a tension roll, and a carrier belt traveling over the rolls and forming a continuous loop. The guide roll can be displaced to a location parallel to its axis and at an angle to the direction of movement of the carrier belt. The guide roll and the tension roll are coupled to each other in such a way that, when the guide roll is displaced, the tension roll is simultaneously displaced in such a direction and to such an extent that the carrier belt tension remains at least approximately constant.

Other objects and advantages of the invention will be apparent to those skilled in the art from the following detailed description taken in conjunction with the drawings and the appended claims.

DETAILED DESCRIPTION OF THE INVENTION

According to the invention, a dryer group includes a guide roll and a tension roll coupled to each other such that when the guide roll is displaced, the tension roll is also displaced simultaneously in such a direction and to such an extent that the tension of the endless belt cooperating with the guide and tension rolls remains approximately constant. Although U.S. Pat. No. 5,050,317 describes a displaceable guide roll 192 or 194 supported on a common frame together with a tension roll 170 (column 7, lines 29–34, in connection with FIG. 2), it does not follow from this disclosure that the two rolls are coupled with each other so that simultaneous displacement of the rolls occurs.

Figure 1:
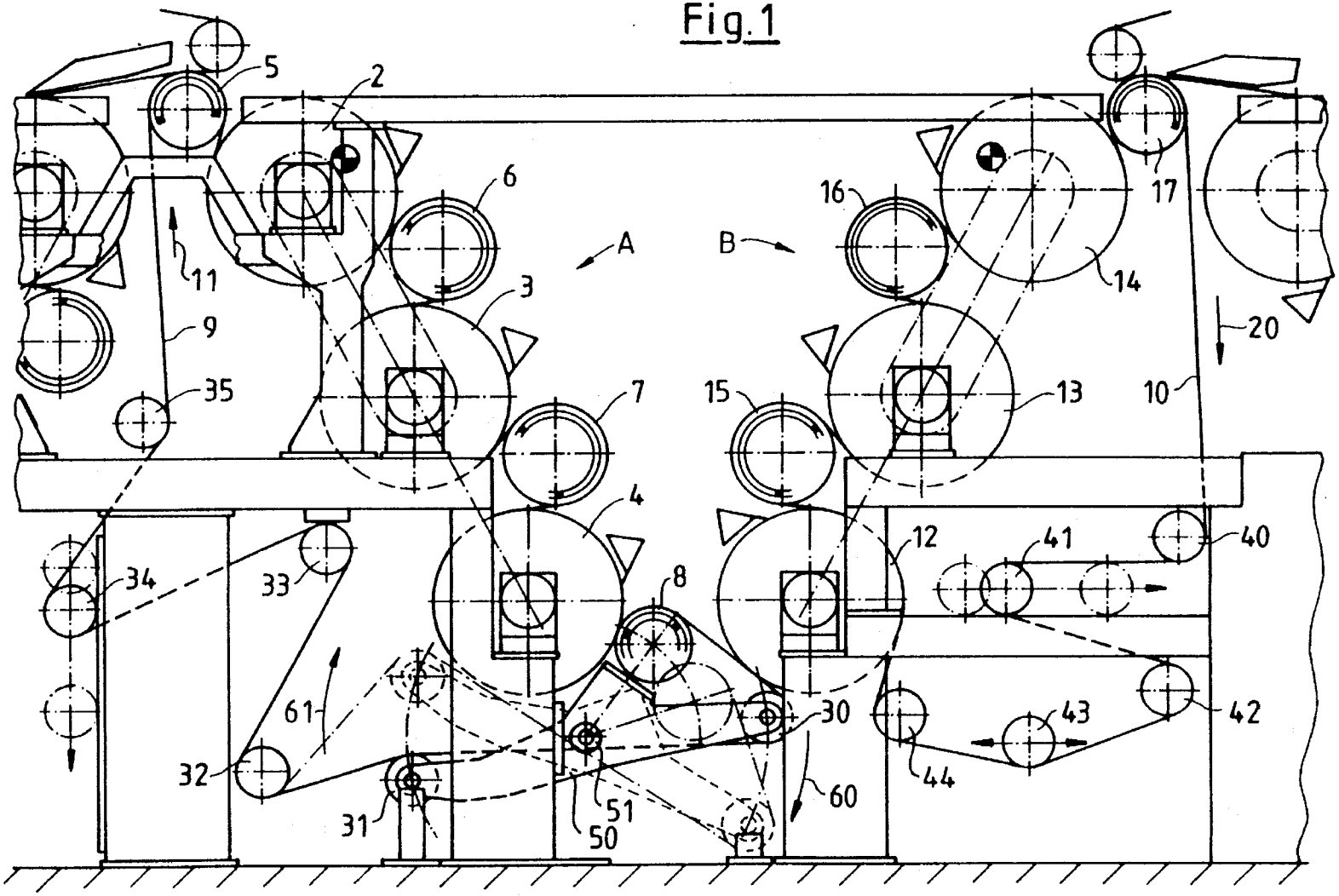
FIG. 1 is a schematic sectional view of a dryer section according to the invention.

The invention is explained in more detail in the drawings. FIG. 1 shows a portion of a dryer section of a paper machine. A paper web loops in succession about dryer components or groups generally designated A and B.

The dryer group A includes three dryer cylinders 2, 3, and 4, disposed in succession and neighboring suction guide rolls 5, 6, 7, and 8. The dryer group A also includes a series of guide rolls 30, 31, 32, 33, 34, and 35. An endless support belt or dryer wire 9 travels over the cylinders 2, 3, and 4 and the rolls 30, 31, 32, 33, 34, and 35 in a continuous loop and moves in a direction indicated by an arrow 11.

Similar to the dryer group A, the dryer group B has three dryer cylinders 12, 13, and 14, three suction guide rolls 15, 16, and 17, five guide rolls 40, 41, 42, 43, and 44, and a continuous belt or dryer wire 10 looped thereabout. The wire 10 moves around the cylinders and rolls in a direction indicated by an arrow 20.

As shown in FIG. 1, a connecting line running through the dryer cylinders of the first dryer group A forms a V with a connecting line running through the dryer cylinders of the second dryer group B.

A rocker 50 supports the suction guide roll 8, and the guide rolls 30 and 31. The rolls 8, 30 and 31 assist in maintaining the wire 9 under tension, and thus also function as tension rolls. The rocker 50 can be swiveled around an axis 51 thereof. The axis 51 is parallel to longitudinal axes of the dryer cylinders as well as to longitudinal axes of the other rolls. The position of the rocker 50 shown by a solid line in FIG. 1 is a working position of the rocker 50.

Another dryer component or group (not shown) is connected before the dryer group A, i.e., upstream of the dryer group A with respect to a direction of travel of a paper web through the paper machine, and a further dryer group (not shown) is connected downstream of the dryer group B with respect to a direction of travel of a paper web through the paper machine. However, such dryer groups are not further discussed herein. Other types of paper machine components or units can be disposed upstream and downstream of dryer groups A and B. For example, a press part may be disposed upstream of the dryer group A.

The two dryer groups A and B operate as follows: The dryer group A takes over a paper web (not shown here in detail) from an upstream paper machine unit by transfer of the web with the aid of the dryer wire 9 and the suction guide roll 5. As the paper web loops about the suction guide roll 5, the paper web is disposed outside of the dryer wire 9. Then, together with the dryer wire 9, the paper web is conveyed to the dryer cylinder 2, during the conveyance of which the web is sandwiched between a surface of the dryer cylinder 2 and the dryer wire 9. Thereafter, the paper web is further transported in succession to the suction guide roll 6, the dryer cylinder 3, the suction guide roll 7, the dryer cylinder 4, and the suction guide roll 8. In the region of the suction guide roll 8 which is a transfer region between the dryer groups A and B, the paper web is transferred from the dryer group A to the dryer group B by conveyance of the paper web from the dryer wire 9 to a surface of the dryer cylinder 12. In the transfer region between dryer groups A and B, the paper web is sandwiched for a short time between the dryer wire 9 and the surface of the dryer cylinder 12. The paper web then follows the surface of the dryer cylinder 12 and becomes sandwiched between the cylinder 12 and the dryer wire 10 of the dryer group B.

If the paper web tears, the rocker 50 is swiveled to a position shown by a dashed line in FIG. 1. During this swiveling, the portion of the dryer wire 9 which is between the suction roll 8 and the guide/tension roll 30 is moved away from the surface of the dryer cylinder 12. As a result, the path of the paper web is opened so that the paper web can fall down through an open gap into a machine cellar for recycling. The swiveling of the rocker 50 occurs about the axis 51 in a direction indicated by an arrow 60.

During the swiveling of the rocker 50 the total path of the dryer wire 9 is shortened. However, at the same time, the guide/tension roll 31 acts as a tension roll as it is swiveled in a direction indicated by an arrow 61. The swiveling movements of the rolls 8, 30, and 31 carried by the rocker 50 are necessarily coupled to one another, so that the tension of the dryer wire 9 remains the same at all times and displacement of the dryer wire 9 cannot occur.

Figure 2:
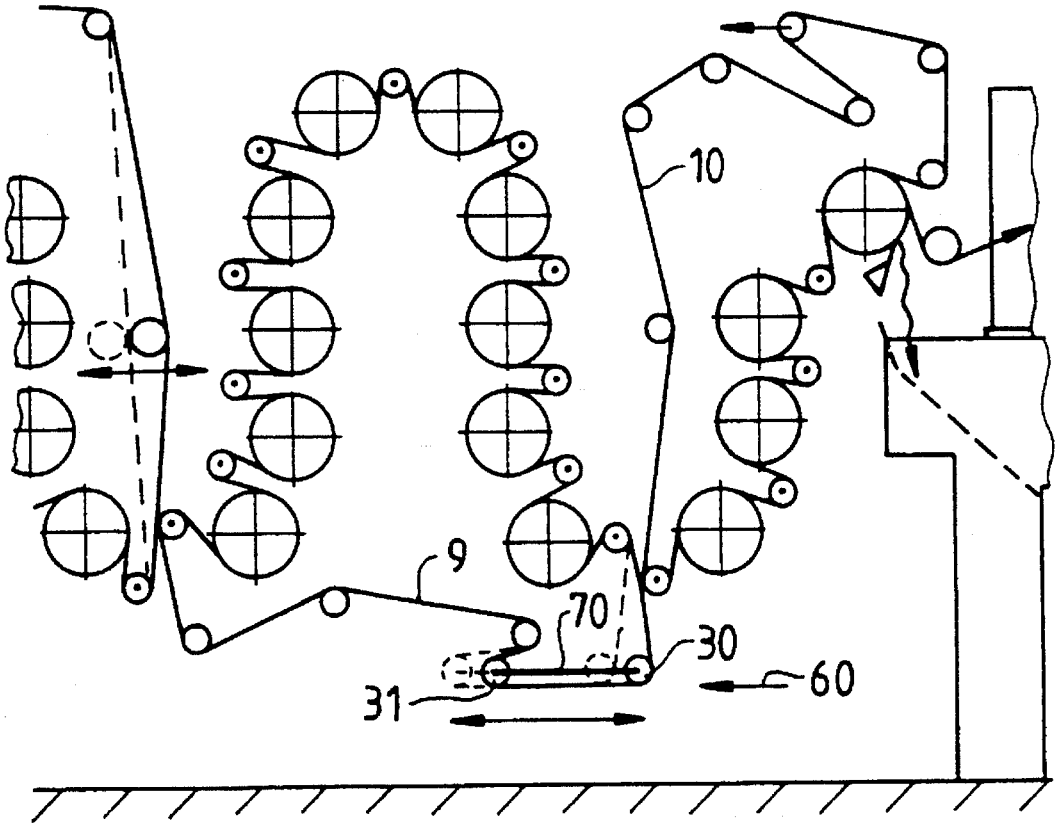
FIG. 2 is a schematic sectional view of a second embodiment of a dryer section according to the invention.

FIG. 2 also shows two dryer groups disposed in succession. A guide roll 30' can be displaced in a direction indicated by an arrow 60' to provide an opening at a transfer region between two dryer wires 9' and 10'. A neighboring tension roll 31' is rigidly coupled to the guide roll 30' by a rod 70' so that when the guide roll 30' is displaced, the tension roll 31' is simultaneously displaced with positive locking. The slackening of the dryer wire 9' due to the displacement of the guide roll 30' is compensated for instantly by tightening of the wire 9' due to the controlled displacement of the tension roll 31'.

Modifications of embodiments according to the invention described herein are also possible. In the embodiment shown in FIG. 1, it is possible to support only the guide/tension roll 30 and the guide/tension roll 31 on the rocker 50, but not the suction guide roll 8. Furthermore, the guide/tension roll 30 and the roll 8 can be displaced together, while allowing the roll 31 to remain stationary. Also, various participating rolls, for example, the guide roll 31, can be supported rigidly or flexibly.

Finally, the invention can be applied independently of whether the transfer region is between two bottom felt groups, between a bottom and a top felt group or between a top felt group and a bottom felt group.

The foregoing detailed description is given for clearness of understanding only, and no unnecessary limitations should be understood therefrom, as modifications within the scope of the invention will be apparent to those skilled in the art.

We claim:

1. A paper machine component comprising:

a plurality of rolls, including at least one guide roll and at least one tension roll; and a carrier belt traveling over said rolls in a continuous loop, said guide roll being displaceable to a location parallel to an axis thereof and at an angle to a direction of movement of the carrier belt; and means for coupling said tension roll to said guide roll in such a way that, when said guide roll is displaced, said tension roll is also displaced simultaneously in such a direction and to such an extent that a tension of the carrier belt remains at least approximately constant.

2. The component of claim 1 wherein said means for coupling said guide roll to said tension roll is mechanical.

3. The component of claim 2 wherein said means for coupling said guide roll and said tension roll comprises a rocker, said guide roll and said tension roll being disposed on said rocker, one of said guide and tension rolls being supported at one lever arm of the rocker and the other of said rolls being supported at the other lever arm of the rocker.

4. The component of claim 1 wherein one of said guide and tension rolls is disposed within the loop of the carrier belt and the other of said guide and tension rolls is disposed outside the loop of the carrier belt.

5. The component of claim 4 wherein one of said guide and tension rolls is a suction roll.

6. The component of claim 1 wherein said tension roll can be swiveled and is rigidly coupled to said guide roll.

* * * * *